United States Patent [19]

Everson

[11] Patent Number: 4,655,002

[45] Date of Patent: Apr. 7, 1987

[54] RAILROAD CROSSING WARNING GATE

[76] Inventor: Clifford R. Everson, 1408 16th Ave., Camanche, Iowa 52730

[21] Appl. No.: 887,744

[22] Filed: Jul. 21, 1986

[51] Int. Cl.[4] ..... E05D 15/40; E01F 13/00

[52] U.S. Cl. ..... 49/246; 49/9; 49/49; 49/237

[58] Field of Search ..... 49/246, 247, 9, 49, 49/35, 192, 236, 237

[56] References Cited

U.S. PATENT DOCUMENTS

| | | | |
|---|---|---|---|
| 1,271,877 | 7/1918 | Farman | 49/247 |
| 1,592,972 | 7/1926 | Farnsworth | 49/247 X |
| 1,665,157 | 4/1928 | Dahnke | 49/247 |
| 1,997,199 | 4/1935 | Pranger | 49/247 |
| 4,531,325 | 7/1985 | Phillips | 49/49 |

*Primary Examiner*—Philip C. Kannan
*Attorney, Agent, or Firm*—Glenn H. Antrim

[57] ABSTRACT

To prevent breakage, an end section that can be positioned across a roadway is connected through a slanting pivot to a supporting section, the raised and lowered positions of the supporting section being under control of a usual standard. The pintle of a hinge for the pivot lies along slanting abutting ends of the supporting section and the end section such that the end section while the sections are horizontal is maintained in position by gravity. An L-shaped latching device has a weight at one end, an intermediate pivot, and a latch at the other end to latch the sections together by gravity while the sections are raised from a horizontal position, the latch retaining said end section upright while the supporting section is fully raised.

2 Claims, 5 Drawing Figures

RAILROAD CROSSING WARNING GATE

BACKGROUND OF THE INVENTION

This invention pertains to railroad signal gates, and particularly to gates having outer swinging portions for protecting the arms of the gates from damage by highway traffic.

Several U.S. patents show for protection of signal arms, outer or end portions pivoted to swing horizontally either about vertical pivots or in any direction about universal arrangements. The end sections are held in their normal positions and are returned to their normal positions when required by springs that exert forces between supporting sections and end sections. Such arrangements are shown in U.S. Pat. No. 1,592,972 issued to F. B. Farnsworth on July 20, 1926, and in U.S. Pat. No. 1,271,877 issued to D. V. Farman on July 9, 1918. These patents also show locking or latching devices effective as the signal arms are moved from horizontal positions to maintain the pivoted sections of the signal arms in alignment.

SUMMARY OF THE INVENTION

The end section of a signal arm according to the present invention is rotatable about a slanting pivot such that the arm can be pushed both toward a railroad and upward about a single pivot. By using a slanting pivot, all springs are eliminated because the end section is held in its normal position by gravity and is likewise returned to its normal position by gravity when displaced by oncoming traffic. As viewed from the end of the signal arm attached to a standard, the abutting ends of the supporting section and the end section are slanted upward and outward from the lower edge of the arm, preferably at about 45 degrees. A hinge is connected between the sections, the straps of the hinge being attached to the respective sides facing an adjacent railroad, and the pintle of the hinge lies along the joint provided by the two abutting ends along the side of the signal arm facing the railroad. The abutting ends function as a stop to prevent rotation of the end section in a direction away from the railroad, and the weight of the end section provides the required torque around the pintle to maintain the end section in alignment with the supporting section except when the end section is pushed in a direction toward an adjacent railroad.

A latching or locking assembly has a pair of arms and a weight for holding by gravity a contact or restraining portion of one of the arms of the locking assembly slightly above the end section while the signal arm is horizontal. When a standard starts to raise the signal arm, a portion of the end section opposite the contact portion of the latching device begins to overlap the latching device such that as the end section starts to rotate, a side of the end section will bear against the contact portion and the end section is restrained from rotation. As the end section continues upward, a stop portion of the latching device is contacted by the rising end section to maintain the contact surface in position. The stop raises the weight, and the weight continues to urge the stop against the end section. According to the present arrangement, only two simple, reliable assemblies are required, and the assemblies are operated only by gravity rather than by springs.

DESCRIPTION OF THE PREFERRED EMBODIMENT

Figure 1:
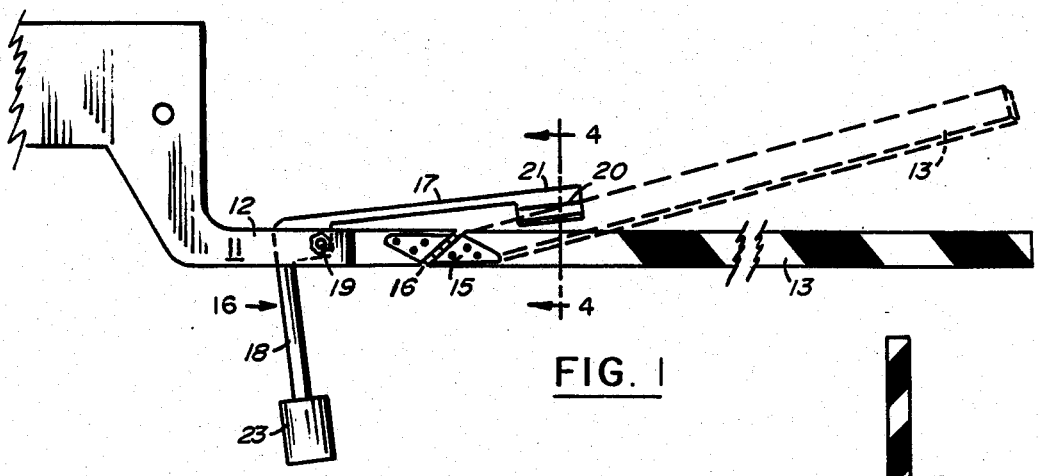
FIG. 1 is a side view of the signal arm of this invention as viewed from the direction of an adjacent railroad.
Figure 5:
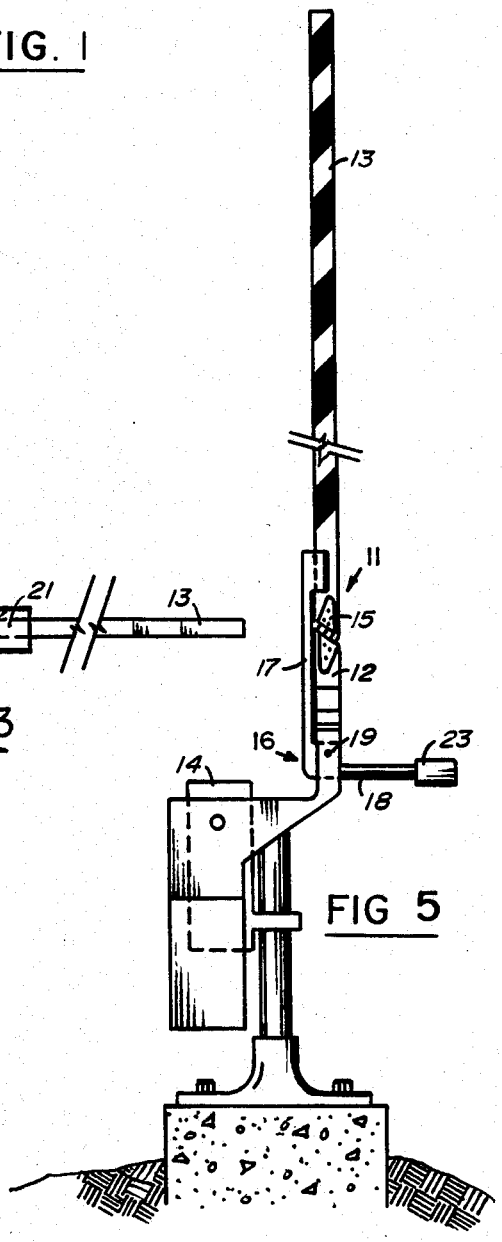
FIG. 5 is a side view of the crossing gate of FIG. 3 using the latching device to maintain the end section in an upright position.

As shown in FIG. 1, a signal arm 11 of this invention comprises a relatively short supporting section 12 and an abutting end section 13 for extending across a highway. The supporting section 12 is connected to a usual standard 14 (FIG. 5) for changing the position of the signal arm 11 from a horizontal position as shown in FIG. 1 to a vertical position as shown in FIG. 5.

Whereas the abutting ends of the supporting section 12 and the end section 13 are preferably as usual at right angles with respect to the sides of the sections, they are with respect to lower and upper edges of the sections slanted upward and outward as viewed from the standard 14 and the lower edges of the sections while the signal arm 11 is horizontal. Each end strap of the hinge 15 is connected to a respective side of the section 12 and 13 such that when the sections are aligned the abutted ends are tightly together, the pintle 16 of the hinge 15 is aligned over the joint formed by the abutted ends, the pintle being adjacent the sides of the sections that are to face a railroad. Therefore, when the supporting section 12 is horizontal, the end section 13 tends to hang straight outward in alignment with the section 12. The abutting ends function as a stop, and if necessary, protruding stop members may be provided at the abutting ends on the sides of the sections opposite a railroad to prevent rotation in a direction away from the railroad.

Figure 2:
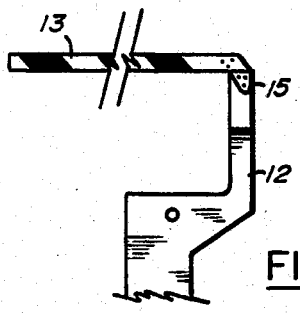
FIG. 2 is a side view of the signal arm of FIG. 1 to show a position of an end section of a signal arm without a latching device.

As shown in FIG. 2, the hinged sections 12 and 13 may be used without a latching device, and then the end section 13 will be rotated to a position at right angles to the supporting section 12 as the section is being rotated from a horizontal to a vertical position. Usually, room is not provided for extension of the end section 13 to the side of a road, and a latching device 16 as shown in FIG. 1 is preferred to maintain the end section 13 upright as shown in FIG. 5.

A latching device 16 is mainly a lever having two arms at right angles, the latching arm 17 extending along the signal arm 11 and an operating arm 18 extending downward while the signal arm 11 is horizontal. A pivot 19 for connecting the device 16 to the supporting section 12 is located somewhat inside the angle of the arms 17 and 18 and at a point far enough from the standard 14 for the operating arm 18 to clear the standard while the signal arm 11 is horizontal. The latching arm 17 extends from the pivot 19 in a direction away from the standard 14 clear of the supporting section 12 to a position just above the inner end of the end section 13. The end of the latching arm 17 over the end section 13 has a vertical contact surface 20 to contact that side of the end section 13 facing a railroad and a stop portion 21 to fix the position of the contact portion 20 on the adjacent side of the end section 13 when the end section 13 is moved from a horizontal position.

Figure 4:
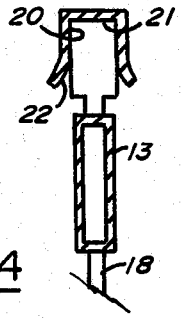
FIG. 4 is a cross-sectional view of the latching portion and the end section of FIG. 1 on the line 4—4.

As shown in the cross section in FIG. 4, a suitable shape for the outer end of the latching arm 17 is an inverted U-shape having outwardly flared lower edges 22. The upper, inside surface functions as a stop portion 21 to bear against the top edge of the end section 13, and the inside surface that is normally positioned almost directly above the side of the end section 13 that faces a railroad functions as the contact portion 20. The inside surface opposite the contact portion 20 and its outwardly flared edge function as a guide.

The angle suspended by the arms 17 and 18 may be a right angle or slightly larger than a right angle, and the pivot 19 is positioned with respect to the apex of the angle to maintain the contact portion 20 and its lower flared edge 22 slightly above the end section 13. A weight 23 is connected to the lower end of the operating arm 18 for positioning the latching arm 17. The exact position of the pivot 19 with respect to the vertex of the arms 17 and 18 depend upon whether the included angle is a right angle or is somewhat greater than a right angle and the relative weights of the latching arm 17 and the weight 23.

Figure 3:
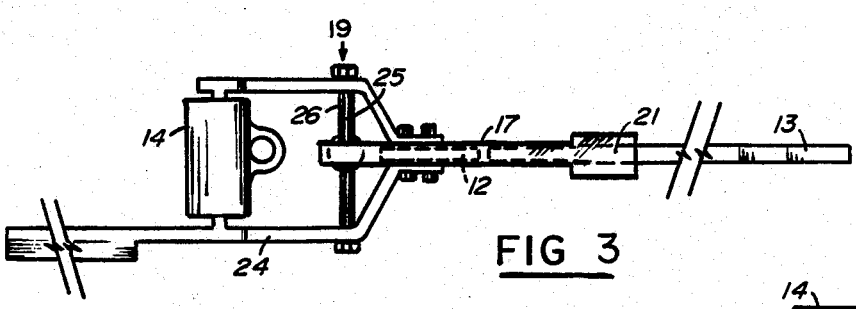
FIG. 3 is a top view of a crossing gate with the signal arm of FIG. 1 to show the connection of a latching device.

A suitable bearing for the pivot 19 may comprise as shown in FIG. 3 a rod 25 connected between the sides of a yoke 24 connecting the supporting section 12 to the standard 14, and a sleeve or pipe 26 that is a close rotative fit about the rod 25. The arms 17 and 18 are fastened perpendicularly to the sleeve 26, and the sleeve has sufficient length to prevent significant lateral movement between the sides of the yoke 24.

When a vehicle on a road is unable to stop before contacting the signal arm 11, the end section 13 as shown in dashed lines in FIG. 1 will be pushed to rotate around the pintle 16 in the direction of the motion of the vehicle and upward to prevent breakage. The arm 13 can then be raised and the vehicle cleared of the arm.

When the standard 14 operates to raise the signal arm 11, the end section 13 moves only a short distance upward before engaging the contact portion 20 of the latching arm 17, and then immediately the upper edge of the arm 13 engages the stop portion 21. The weight 23 forces the stop portion 21 against the upper edge of the end section 13 for raising the weight as shown in FIG. 5 for retaining the contact portion 20 in contact with the side of the end section 13.

I claim:

1. A protected signal arm for a railroad crossing gate having a relatively short supporting section and an elongated abutting end section, said supporting section to be connected to a standard for moving said signal arm between an upright position and a horizontal position, a hinge connecting said end section to said supporting section, said hinge having a pintle aligned over the abutment of said supporting section and said end section, said abutment being inclined outward at a substantial angle with respect to a perpendicular line across said arm in a direction away from said standard and from that edge of said signal arm that is the lower edge while said signal arm is horizontal, said pintle being adjacent that side of said arm to be facing a railroad and therefore opposite oncoming traffic on a highway such that said end section is normally maintained straight outward by gravity while said supporting section is horizontal and is rotatable slantingly upward about said pintle for movement out of the way by any contact with oncoming traffic on said highway.

2. A signal arm as claimed in claim 1 having a latching device operated by gravity to hold said end section in alignment with said supporting section while said supporting section is in said upright position, said latching device comprising a lever and a weight, said lever having a latching arm extending along respective adjacent portions of said supporting section and said end section and an operating arm extending downward from an approximate end of said latching arm while said signal arm is in said horizontal position, said approximate end being near said standard along said supporting section, said latching arm on the distal end thereof having a contact portion to be positioned in an overlapping restraining position adjacent that side of said end section aligned with said pintle and a stop portion for engaging said end section while said contact portion is in said restrain ing position, a pivot between said supporting section and said lever, said pivot permitting rotation of said lever only about an axis perpendicular to the sides of said arm, said weight being connected to said operating arm at a point spaced from said pivot, said pivot being positioned relative to said approximate end for permitting said weight to position said contact portion a short distance above said end section while said arm is in said horizontal position, and in response to being raised any substantial distance above said horizontal position by operation of said standard said end section overlapping said contact portion for restraining rotation of said end section about said pintle, said weight while said arm is raised urging said stop portion against said end section to maintain said contact portion in said restraining position for preventing rotation of said end section about said pintle.

* * * * *